United States Patent [19]

Feinstein et al.

[11] 4,150,061

[45] Apr. 17, 1979

[54] PROCESS FOR CONVERTING PYROLYSIS GASOLINE TO BENZENE AND ETHYLBENZENE-LEAN XYLENES

[75] Inventors: Allen I. Feinstein, Wheaton; Un K. Im, Naperville, both of Ill.

[73] Assignee: Standard Oil Company (Indiana), Chicago, Ill.

[21] Appl. No.: 849,606

[22] Filed: Nov. 8, 1977

[51] Int. Cl.[2] ..... C07C 3/62

[52] U.S. Cl. ..... 260/672 T; 260/672 R

[58] Field of Search ..... 260/672 T, 672 R

[56] References Cited

U.S. PATENT DOCUMENTS 3,720,726 3/1973 Mitsche et al. ..... 260/672 T

*Primary Examiner*—C. Davis

*Attorney, Agent, or Firm*—William C. Clarke; Arthur G. Gilkes; William T. McClain

[57] ABSTRACT

Fractionated pyrolysis gasoline containing toluene, xylenes, ethylbenzenes, $C_7$–$C_9$ paraffins, olefins and naphthenes are selectively hydrodealkylated and transalkylated to give ethylbenzene-lean xylenes and benzene in the presence of a catalyst comprising a tungsten/molybdenum component of $WO_3$ and $MoO_3$ and an acidic component of 60 (wt)% of mordenite and 40 (wt)% of catalytically active alumina.

10 Claims, 1 Drawing Figure

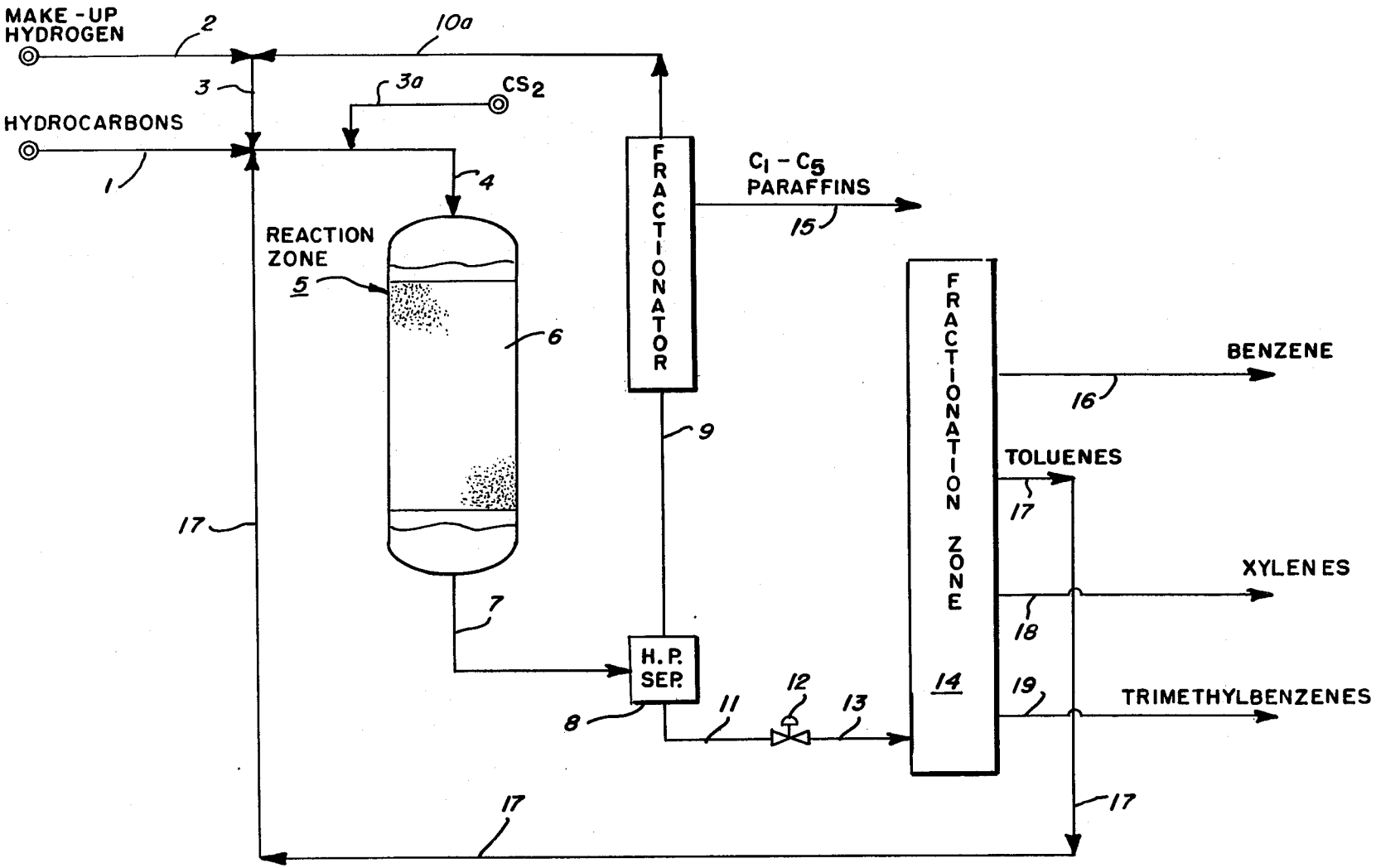
MAKE-UP HYDROGEN
HYDROCARBONS
CS2
REACTION ZONE
FRACTIONATOR
C1 - C5 PARAFFINS
H.P. SEP.
FRACTIONATION ZONE
BENZENE
TOLUENES
XYLENES
TRIMETHYLBENZENES
1
2
3
3a
4
5
6
7
8
9
10a
11
12
13
14
15
16
17
18
19

PROCESS FOR CONVERTING PYROLYSIS GASOLINE TO BENZENE AND ETHYLBENZENE-LEAN XYLENES

BACKGROUND OF THE INVENTION

This process relates to a method for the selective hydrodealkylation and transalkylation of aromatic hydrocarbons and the cracking of paraffins. Alkyl aromatic compounds have long been produced from hydrocarbon fractions relatively rich in such materials. Early sources were liquids from coking or other distillation of coals. More recently, these products have been derived from fractions obtained in refining of petroleum. An important source in recent years has been the aromatic liquid naphthas known as pyrolysis gasoline resulting from the thermal cracking of gases, naphthas, and gas oils to produce olefins.

However derived, these aromatic-ring streams have usually been distilled and otherwise separated (e.g. solvent extraction) to obtain the desired product components. The purpose of these operations typically has been to obtain $C_8$ aromatics and benzene which are now used in huge quantities in the manufacture of terephthalic acid and other chemical products. The separated streams usually resulting from the above separation by distillation or other means consist of product streams of benzene, toluene, $C_8$ aromatics containing xylenes and a bottoms product of $C_9$ and $C_{10}$+ aromatics. The pyrolysis gasoline stream yields a $C_7$–$C_9$ fraction which is usually blended into automotive gasoline.

This invention accordingly relates to a conversion process for the hydrodealkylation and transalkylation of fractionated pyrolysis gasoline containing ethylbenzene into more useful compounds. More specifically, this invention is concerned with a conversion process for the concurrent transalkylation and hydrodealkylation of a fractionated pyrolysis gasoline stream containing toluene, ethylbenzene and xylenes into ethylbenzene-lean xylenes and benzene utilizing a catalyst comprising a tungsten/molybdenum component of $WO_3$ and $MoO_3$ and an acidic catalyst of 60 (wt)% mordenite and 40 (wt)% catalytically active alumina.

The $C_8$ aromatics found in pyrolysis gasoline generally contain approximately 44% ethylbenzene. The presence of ethylbenzene in mixed xylenes is detrimental to process yields and process economics when these xylenes are utilized in the production of p-xylene. Fractional distillation to remove ethylbenzene from mixed xylenes is not economically practical because of the closeness of their boiling points. Ethylbenzene can be removed from xylenes by repeated recrystallizations but this is economically very expensive and is technically difficult.

Pyrolysis gasoline is produced in an olefins plant by a steam cracking process which optimizes olefin production of carbon chain length of from $C_2$ to $C_4$. The composition of pyrolysis gasoline depends upon various factors, i.e., kind of feedstock, type of cracking unit and cracking conditions. All pyrolysis gasolines generally contain considerable amounts of aromatics, normally 40–80% benzene, toluene and xylenes, together with paraffins, naphthenes, olefins and diolefins. Pyrolysis gasoline is generally unstable and must be stabilized by selective hydrogenation immediately upon production in the olefins plant.

In the prior art, a pyrolysis gasoline stream from an olefins plant is hydrotreated with hydrogen to stabilize the stream and desulfurized to remove the sulfur. The stream is thereupon distilled in an aromatics recovery unit to remove the benzene, toluene and $C_8$–$C_9$ fractions. The $C_8$–$C_9$ fraction which includes $C_8$ aromatics that contain 42–44% ethylbenzene are generally returned to the refinery to be used in gasoline blending at a lower economic value than the other products of the olefins plant.

In the prior art, a number of processes are peripheral to the instant invention of a process for producing benzene and ethylbenzene-lean xylenes from pyrolysis gasoline, but no processes are directly related to the instant invention.

There is no process utilizing hydrodealkylation and/or transalkylation in the prior art wherein toluene yields benzene and xylenes, ethylbenzene yields benzene, high boiling $C_7$–$C_9$ paraffins and olefins yield $C_1$–$C_5$ paraffins and xylenes are left unchanged simultaneously with a single catalyst, without side-reactions producing undesired products by hydrodemethylation thus destroying the desired products namely, the xylenes.

For example, U.S. Pat. No. 3,478,120 relates to a process and catalyst for the dealkylation of hydrocarbons which comprises contacting the said hydrocarbons with a catalyst comprising iron group metals and calcium aluminate. A stream comprising ethylbenzene and xylenes can be subjected to dealkylating conditions whereby the ethylbenzene and xylenes are selectively dealkylated to methane, ethane, toluene and benzene.

In another example, U.S. Pat. No. 3,919,339, discloses a process for selective hydrodealkylation of ethylbenzene to toluene and benzene in a hydrocarbon feedstock comprising ethylbenzene and xylenes, and for simultaneous isomerization of the xylenes to p-xylene. The U.S. Pat. No. 3,919,339 process comprises contacting the feedstock with a catalyst comprising a cobalt or nickel component on an acidic inorganic refractory oxide support at a temperature between 650°–950° F., a pressure below 300 psig and a hydrogen-to-hydrocarbon feed ratio between 1:1 and 20:1. Preferably, the catalyst used is cobalt on silica:alumina.

U.S. Pat. No. 3,957,621 discloses a method for the preparation of alkyl aromatic hydrocarbons by the processing of a fraction of heavy reformate, those from which benzene and lighter components have been largely removed by distillation. The fraction is hydrocracked over a zeolite catalyst associated with a hydrogenation/dehydrogenation component. Ethylbenzene is selectively removed from the charge stock which occurs in part by dealkylation of the side chain and in part by disproportionation to benzene and $C_9$+ alkylbenzenes such as ethyltoluene and diethylbenzene instead of benzene and xylenes as in the instant application.

Alkyl aromatics such as toluene or ethylbenzene can be disproportionated to benzene and polymethylbenzenes, and benzene and polyethylbenzenes, respectively, as is disclosed in U.S. Pat. No. 3,578,723 by use of the crystalline zeolite catalyst ZSM-4. U.S. Pat. No. 3,578,723 does not teach dealkylation of ethylbenzene to benzene and ethane.

In another approach, ethylbenzene in a hydrocarbon stream can be dehydrogenated to styrene according to U.S. Pat. No. 3,720,726 using a zeolite catalyst having a mordenite crystal structure containing alumina fixed in combination therewith.

Accordingly, in the prior art there are a number of processes to dealkylate alkyl aromatics to benzene and polymethylbenzenes. Also, processes are in the prior art to dehydrogenate ethylbenzene to styrene. However, the prior art has not disclosed the process utilizing a catalyst composition comprising a tungsten/molybdenum component of $WO_3$ and $MoO_3$ and an acidic component of 60 (wt)% of mordenite and 40 (wt)% of catalytically active alumina whereby a heavy aromatics fraction of pyrolysis gasoline containing toluene, ethylbenzene, xylenes and sizeable amounts of non-aromatics selectively hydrodealkylated and transalkylated to ethylbenzene-lean xylenes and benzene.

SUMMARY OF THE INVENTION

This invention comprises a hydrodealkylation/transalkylation process for selectively hydrodealkylating and transalkylating a heavy aromatics fraction from pyrolysis gasoline within the boiling point range of from about 230° to 340° F., which contains toluene, $C_7$–$C_9$ paraffins, ethylbenzene, xylenes and quantities of $C_9$ aromatics to ethylbenzene-lean xylenes and benzene, and hydrocracking high-boiling paraffins and naphthenes to $C_1$–$C_5$ paraffins which process comprises contacting the feedstock with a catalyst comprising tungsten/molybdenum components on a mordenite base suspended in a matrix of a refractory inorganic oxide at a temperature in the range from about 600° to 1000° F. and a pressure of from about 100 to 1000 psig.

DETAILED DESCRIPTION OF THE INVENTION

The present invention selectively hydrodealkylates and transalkylates the $C_7$–$C_9$ aromatic components of the pyrolysis gasoline stream to produce ethylbenzene-lean xylenes and benzene. High boiling $C_7$–$C_9$ paraffins and olefins in the stream are concurrently cracked to $C_1$–$C_5$ paraffins which are a valuable feed for the olefins plant. Particularly, it is a process for the hydrodealkylation and transalkylation of pyrolysis gasoline containing alkyl aromatic hydrocarbons wherein ethyl groups are dealkylated and alkyl groups of one carbon are transferred from one molecule to another.

The success of this hydrodealkylation/transalkylation process is due primarily to the use of particular catalytic compositions which are employed therein and the operating conditions that are used.

Typical feedstocks of the present invention are hydrocarbon streams which contain single-ring aromatic hydrocarbons which boil within the range from about 230° to 340° F. and contain predominantly 7 to 8 carbon atoms and a small quantity of hydrocarbons containing 9 carbon atoms. Such aromatic hydrocarbon streams are usually a hydrocarbon fraction derived from the pyrolysis gasoline stream from an olefins plant. Accordingly, the feedstock of this invention can contain ethylbenzene, xylenes, toluene and paraffins, olefins and naphthenes of 6–9 carbon atom chain length and small quantities of $C_9$ aromatics. A preferred fresh feedstock is one containing a toluene/$C_8$ aromatic mole ratio greater than 1.4:1.

Typically the $C_7$–$C_9$ fraction of hydrogenated pyrolysis gasoline is mixed with a hydrogen-containing gas and preheated to a suitable temperature, and then transferred to the hydrodealkylation/transalkylation reaction zone, which may contain one or more reactors. Advantageously, the feed is substantially completely vaporized before being introduced into the reaction zone.

The feedstock is contacted in the reaction zone with the hereinafter described catalyst in the presence of hydrogen-affording gas. Advantageously, a hydrogen-to-hydrocarbon mole ratio of at least 1:1 is employed, and the hydrogen-to-hydrocarbon mole ratio can range up to 50:1. Preferably, the hydrogen-to-hydrocarbon mole ratio can range between 4:1 to about 10:1 at approximately 465 psig. The contact time is of the range of 1 to 20 seconds, preferably 3 to 10 seconds, wherein contact time is defined as bulk volume of the catalyst divided by volumetric flow rate of reactants and hydrogen. Other operating conditions comprise an elevated temperature of about 600° F. to about 1000° F., preferably about 750° F. to about 950° F.; an elevated pressure of about 100 psig to about 1,000 psig, preferably about 150 psig to about 500 psig; and a space velocity (WHSV) of about 0.1 to about 20 weights of hydrocarbon per hour per weight of catalyst, preferably about 1 to about 10 weights of hydrocarbon per hour per weight of catalyst.

Side reactions such as hydrogenation of the aromatic ring are controlled by the sulfiding of the catalyst to the sulfided form with sulfur compounds, such as hydrogen sulfide and carbon disulfide, either prior to or at the start of the hydrodealkylation/transalkylation reaction. If hydrogen sulfide is used, the catalyst is advantageously subjected to the hydrogen sulfide prior to its use as a catalyst for hydrodealkylation/transalkylation. If carbon disulfide is employed, it may be added to the hydrocarbon feed during the initial stages of the run.

The catalytic composition of the process of this invention comprises a hydrogenation component disposed upon a solid acidic cracking support. The hydrogenation component comprises two members selected from the group consisting of the oxides of metals of Group VIb of the Periodic Table of Elements and mixtures thereof. The pertinent Periodic Table of Elements may be found on the inside of the back cover of HANDBOOK OF CHEMISTRY AND PHYSICS, 45th edition, Robert C. Weast, editor, Chemical Rubber Company, Cleveland, Ohio (1964). The preferred Group VIb metals are tungsten and molybdenum. Molybdenum is present in an amount within the range of about 1.0 to about 20 weight percent, expressed as $MoO_3$ and based upon the weight of the catalytic composition, while tungsten is present in an amount within the range of about 1 to about 10 weight percent, expressed as $WO_3$ and based upon the weight of the catalytic composition.

The solid acidic cracking support of the catalyst employed in the process of the present invention comprises a mordenite-type, large-pore crystalline aluminosilicate material and a suitable refractory inorganic oxide. Preferably, the mordenite-type, large-pore crystalline aluminosilicate material is suspended in and distributed throughout the matrix of the refractory inorganic oxide. The mordenite-type, large-pore crystalline aluminosilicate material is present in an amount within the range of about 5 to about 95 weight percent, based upon the weight of the support.

The refractory inorganic oxide component of the support of the catalyst that is employed in the process of the present invention may be an oxide of a single metal, or it may be a mixture of the oxides of two or more metals of Groups III and IV of the Periodic Table of Elements. For example, the refractory inorganic oxide component may be catalytically active alumina, or it may be a mixture of silica and alumina, or it may be a mixture of boria, titania, gallia, and alumina. The preferred refractory inorganic oxide is a catalytically active alumina.

An example of the refractory inorganic oxide component that is employed in the catalyst of this invenion is PHF or Aero-1000 Alumina manufactured by American Cyanamid Corp. It is described as high-purity gamma-alumina, the inspection data being: surface area 206 $m^2/g$, pore volume 0.6 cc/g, average pore diameter 90 Å (Angstroms), sodium content 0.1 wt. %, silicon content 0.02 wt. %, iron content 0.025 wt. %.

The aluminosilicate material that is a component of the support of the catalytic composition that is employed in the process of the present invention is a mordenite-type, large-pore crystalline aluminosilicate material. It is sometimes hereinafter referred to as "mordenite aluminosilicate material." By large pore material is meant a material that has pores which are sufficiently large to permit the passage thereinto of benzene molecules and larger molecules, and the passage therefrom of reaction products. For use in catalysts that are employed in petroleum hydrocarbon conversion processes, it is preferred to employ a large-pore crystalline aluminosilicate material having a pore size of at least 6 to 10 Angstrom units (Å). The mordenite aluminosilicate material of the catalyst of the present invention possesses a pore size of 6–9 Å.

A preferred mordenite-type aluminosilicate material is the synthetic Zeolon manufactured by the Norton Chemical Company. Zeolon-H is the hydrogen form of this synthetic mordenite. Mordenite is characterized by its high silica-to-alumina ratio and its crystal structure. The mordenite may have a silica-to-alumina ratio within the range of about 6 to about 100. The composition of mordenite is given in Kirk-Othmer, "Encyclopedia of Chemical Technology," first edition, Volume 12, page 297 (1954), as $(Ca, Na_2)Al_2Si_9O_{22}.6H_2O$. The proposed structure is one in which the basic building block is a tetrahedron consisting of 1 silicon or aluminum atom surrounded by four oxygen atoms. The crystal structure is made up of 4- or 5-membered rings of these tetrahedra. These 4- and 5-membered rings are believed to give the structure its stability. The chains are linked together to form a network having a system of large parallel channels interconnected by small cross channels. Rings of 12 tetrahedra form the large channels. Other synthetic zeolites also have such 12-membered rings, but they have interconnected cages, whereas the mordenite has parallel channels of uniform diameter. For example, synthetic faujasite, which has the formula $Na_3Al_3Si_4O_{14}$, is characterized by a 3-dimensional array of pores which consist of 12–13 Angstrom (Å) cages interconnected through 6–9 Å windows.

The mordenite aluminosilicate material that is preferred, the Zeolon manufactured by the Norton Chemical Company, with its high ratio of silica to alumina exhibits the ability to undergo complete acid exchange from the original sodium form to the hydrogen form. The theoretical silica-to-alumina ratio is about 10 to 1 and the effective pore diameter in Angstroms (Å) is within the range of 6 to 9 Å. The surface area in square meters/gram is within the range of 400–450$m^2/g$ and its static water capacity in weight percent is within the range of 10–11%.

The mordenite in the catalytic composition of the present invention may be in the unexchanged cation form containing exchangeable sodium and/or calcium ions, or other alkali metal or alkaline earth metal ions. Preferably, the alkali metal cations, such as sodium ions, may be replaced or cation-exchanged with a member selected from the group consisting of an alkaline earth metal, a rare earth metal, hydrogen, and a hydrogen precursor to provide an alkali metal content in the mordenite that is less than 1 weight percent, calculated as the metal. Ammonium ions comprise a hydrogen precursor and may be employed to cation-exchange the alkali metal of the mordenite. Heat is employed to drive off ammonia leaving the mordenite in the hydrogen form. Mordenite differs from other aluminosilicates in that substantially all the exchangeable metal cations may be replaced with hydrogen ions without causing destruction of the characteristic crystal structure of the mordenite.

The porous refractory inorganic oxide that is employed in the catalytic composition of the present invention may be a catalytically active alumina, silica-alumina, silica-magnesia, titania-alumina, zinc-oxide-alumina, gallium oxide-alumina and the like. Catalytically active alumina, such as gamma-alumina and eta-alumina, is the preferred refractory inorganic oxide. Such alumina should have a pore diameter of about 70 Angstroms to about 200 Angstroms and a surface area of at least 100 square meters per gram. Suitably, the surface area should be within the range of about 200 square meters per gram to about 500 square meters per gram.

The co-catalytic composition of the present invention may be prepared in various ways. For example, finely divided mordenite-type aluminosilicate material may be stirred into a sol or gel of the refractory inorganic oxide and soluble compounds of the Group VIb metals added to the sol or gel, followed by the cogelling of the sol or gel mixture by the addition of dilute ammonia. The resulting cogelled material is then dried and calcined. In another method of preparation, the finely divided mordenite is mixed into a sol or gel of the refractory inorganic oxide, the sol or gel mixture is cogelled by the addition of dilute ammonia and the resulting gel is subsequently dried, pelleted, calcined, cooled, and impregnated with a solution or solutions of the Group VIb metals. As an alternate method of preparation, a hydrogel of the refractory inorganic oxide is blended with finely divided aluminosilicate material, and a solution or solutions of soluble compounds of the Group VIb metals are added to this blend, and the resulting mixture is thoroughly blended. The blended mixture is then dried, pelleted, and calcined. Suitable drying conditions for use in the above-described metal manufacturing methods comprise a temperature in the range of about 200° F. to about 400° F. and a drying time of about 5 to 30 hours. Suitable calcination conditions comprise a temperature in the range of about 900° to 1400° F. and a calcination time of about 2 to about 20 hours. Preferred drying and calcination conditions are a temperature of about 250° F. for about 16 hours and a temperature of about 1000° F. for about 6 hours, respectively.

The catalytic composition that is employed in the process of the present invention can be prepared in several other ways. For example, the mordenite-type, large-pore crystalline aluminosilicate material can be pulverized into a finely-divided state and then physically admixed with a finely-divided powder of the selected refractory inorganic oxide component. After a thorough blending of the two solid components, the resulting mixture may be co-pelleted, and impregnated with one or more solutions of the metals of the hydrogenation component, i.e., the metals of Group VIb. The resulting composition is thoroughly mixed to form a blended composition, which is subsequently dried to a moisture content ranging from about 20 to 40 weight percent, based upon the total weight of the composition. The dried material is then calcined at a temperature within the range of about 900° to about 1100° F.

The following is another method of preparation. The mordenite-type, large-pore crystallization aluminosilicate material in a finely-divided state may be added to a hydrosol or a hydrogel of the refractory inorganic oxide component and blended therein to form a homogenous mixture. The hydrogenation component, i.e., the metals of Group VIb, are added in the form of heat-decomposable components to this homogenous mixture. These heat-decomposable components may be added in a single solution or in several solutions. The resulting composition is then thoroughly mixed, dried, and calcined, as described above.

Alternatively, the homogenous mixture of the above paragraph may be dried and pelleted, or dried, and the resulting material may be impregnated with the hydrogenation component, followed by drying and calcining, as described above.

The invention comprises a process for the hydrodealkylation/transalkylation of alkylaromatics which process consists essentially of contacting an alkylaromatic stream in a reaction zone under hydrodealkylation/transalkylation conditions and in the presence of a catalyst to furnish a product containing hydrodealkylated/transalkylated aromatics, said catalyst comprising a hydrogenation component which comprises two Group VIb metals deposed upon a solid support of a co-catalytic component comprising H-mordenite and a porous refractory inorganic oxide, said refractory inorganic oxide being selected from the group consisting of catalytically active alumina or silica-alumina, silica, zirconia, gallium oxide, titania and mixtures thereof, and said Group VIb metals being present as members selected from the group consisting of (1) the elements, (2) their oxides, (3) their sulfides, and (4) mixtures thereof. When the refractory inorganic oxide is alumina, the catalyst co-support contains at least 5 weight % alumina, preferably 80 weight % alumina.

PROCESS DESCRIPTION

A simplified process flow scheme for this embodiment is depicted in FIG. 1. Auxiliary equipment, such as pumps and heat exchangers, is not shown in the drawing. Such auxiliary equipment is well-known to those skilled in the art and the uses and locations of this equipment in this particular process system will be recognized easily by those having ordinary skill in the art.

Fresh feedstock comprising a $C_7$–$C_9$ fraction of hydrogenated pyrolysis gasoline is introduced into the process system by way of line 1. The fraction contains $C_7$–$C_8$ aromatics, $C_7$–$C_9$ paraffins, olefins and naphthene and overhead $C_9$+ aromatics. Hydrogen-containing gas is combined with the reactant stream by way of line 3. Carbon disulfide is added by way of line 3*a*. The resulting mixture with recycle toluene from line 17 is passed through line 4 into reaction zone 5. Reaction zone 5 contains a catalyst bed or catalyst beds 6. The catalyst in this reaction zone comprises 3.0 percent by weight $WO_3$ and 5 weight percent by weight $MoO_3$ on a co-catalytic support comprising 60 percent by weight H-mordenite, large-pore crystalline aluminosilicate material suspended in a matrix of catalytically active alumina. Operating conditions in reaction zone 5 comprise a pressure of 150 psig to 500 psig, a temperature of about 750° F. to about 950° F., a space velocity (WHSV) within the range of about 1.0 to about 10 weights of hydrocarbon per hour per weight of catalyst, and a hydrogen-to-hydrocarbon ratio that does not exceed 10:1 at a pressure of approximately 465 psig.

The effluent from reaction zone 5 is passed through line 7 to high pressure separator 8 wherein the light gases containing hydrogen are separated therefrom. The separated hydrogen-containing gas is passed through line 9 to fractionator 10 to separate low-boiling $C_1$–$C_5$ paraffins. The hydrogen-containing gas is recycled to reaction zone 5. Make-up hydrogen is added to this hydrogen-containing gas after the fractionation by way of line 2 joining line 10*a*. The separated low-boiling hydrocarbons consisting mainly of $C_1$–$C_5$ paraffins are sent to the front end of the olefins plant as a valuable feedstock. The liquid effluent from high pressure separator 8 is passed through line 11 to control valve 12, which permits the pressure to be reduced prior to the passage of the liquid effluent through line 13 to fractionation zone 14. In fractionation zone 14, the liquid is separated into benzene, toluene, xylenes, and some trimethylbenzenes. Each of these streams is separated from one another in the fractionation zone. Benzene is removed by way of line 16, while toluene is taken from line 17 and the xylenes are removed by way of line 18. Trimethylbenzenes are removed from fractionation zone 14 by way of line 19 and sent to the gasoline pool.

The toluene in line 17 joins the fresh feedstock from line 1 to be sent to reaction zone 5.

Reaction conditions in general are as follows: reaction temperatures can range between 600° and 1000° F., preferably between 700°–850° F. The reaction can be conducted at a pressure of from about 100 to about 1000 psig, preferably 150 to 500 psig. Hydrogen to hydrocarbon mole ratios can be within the range of 1:1 to 50:1, preferably 4:1 to 10:1 at approximately 465 psig. Space velocities can be within the range of from about 0.1 to about 20 unit weights of hydrocarbon charge per weight of catalyst per hour (WHSV), preferably about 1:1 to 1:10. Feedstock concentrations can be varied. A preferred fresh feedstock is one containing a toluene/$C_8$ aromatic mole ratio of greater than 1.4:1. Contact times can vary from approximately 1 to 20 seconds. Preferred contact time is 3 to 10 seconds.

Embodiments of the process of the present invention may be found in the following examples. These embodiments and examples are presented for purposes of illustration only and are not intended to limit the scope of the invention.

EXAMPLE I–III

Feedstocks of the composition shown in Table I simulating actual reactor feeds were used in the following examples.

Table I

Typical Composition of a Simulated Pyrolysis Gasoline Reactor Feed

| | Wt. % |
|---|---|
| Toluene | 65.1 |
| Xylenes | 14.7 |
| Ethylbenzene | 10.3 |
| $C_9$ Aromatics | 1.6 |

Table I-continued

| Typical Composition of a Simulated Pyrolysis Gasoline Reactor Feed | Wt. % |
|---|---|
| Benzene | 2.7 |
| $C_7$–$C_9$ Paraffins | 5.6 |
| Total | 100.0 |

The catalyst used in Examples I–III consisted of 5% $MoO_3$/3% $WO_3$ on a gamma-alumina matrix containing 60% mordenite-H. The catalyst was crushed and used in a −20 to +40 mesh (U.S. Sieve) granular form. The B.E.T. surface area of the catalyst was 371 $m^2/g$.

Preparation of the catalyst was accomplished as follows: 2298.9 g of American Cyanamid sol, 9.5% $Al_2O_3$, was blended with 333.4 g of Norton Zeolon-H powdered mordenite sieve, in a Waring blender. The blend was gelled with 100 ml of a 50% $NH_4OH$ solution and dried overnight at 250° F. The dried material was then ground 20/40 mesh and calcined 3 hours at 1000° F.

460 g of the 20/40 mesh base was impregnated with a solution made by dissolving 30.3 g ammonium molybdate and 16.3 g ammonium metatungstate dissolved in 400 ml of distilled water. The sample was dried at 250° F. for 5 hours and calcined in air at 1000° F. for 3 hours. It was made to contain 5% $MoO_3$/3% $WO_3$ supported on 60% mordenite-H/40% $Al_2O_3$.

Prior to use, the catalyst was sulfided with hydrogen sulfide.

The reactor consisted of a tubular stainless steel pipe, 17 inches long, having an inner diameter (I.D.) of 0.5 inches. The reactor was heated by a constant temperature salt bath and the internal reactor temperature was measured by a movable thermocouple located in a thermowell along the reactor axis.

Hydrogen and the hydrocarbon feed were preheated and metered into the reactor system. The liquid and gaseous product streams were separated in a high pressure separator under system pressure. The liquid product was continuously withdrawn and collected under 3 psig pressure. The gaseous products were depressurized to 3 psig and sent directly to an on-line gas chromatograph.

Product samples were collected at intervals of at least 24 hours and analyzed by gas chromatography. The data resulting are summarized in Table II.

TABLE II

Conversion of Pyrolysis Gasoline Fraction to Benzene and Xylenes: Effect of Temperature Catalyst: 5% $MoO_3$, 3% $WO_3$, 60% H-Mordenite/40% $Al_2O_3$

| Example | I | II | III |
|---|---|---|---|
| Conditions | | | |
| Temperature, ° F. | 800 | 850 | 900 |
| Pressure, psig | 465 | 465 | 465 |
| WHSV | 3.8 | 3.5 | 3.6 |
| Contact Time, sec. | 14.0 | 14.8 | 14.8 |
| $H_2$/HC Mole ratio | 6.4 | 6.3 | 5.8 |
| Product Analysis, wt. % | | Yield, wt. % | |
| | Feed | | |
| $C_1$–$C_6$ Paraffins | | 9.9 | 14.7 | 16.8 |
| Methane | | 0.3 | 0.6 | 1.7 |
| Ethane | | 2.9 | 5.5 | 8.4 |
| Propane | | 3.5 | 5.9 | 4.8 |
| Butanes | | 2.5 | 2.2 | 1.6 |
| Pentanes | | 0.6 | 0.5 | 0.3 |
| Hexanes | | 0.1 | — | — |
| $C_7$–$C_9$ Paraffins[a] | 5.6 | — | — | — |
| Benzene | 2.7 | 20.2 | 20.3 | 20.8 |
| Toluene | 65.1 | 39.4 | 37.1 | 36.4 |
| Ethylbenzene | 10.3 | 1.3 | 0.7 | 0.6 |
| Xylenes | 14.7 | 22.2 | 21.1 | 20.1 |
| $C_9$ Aromatics | 1.6 | 6.4 | 5.7 | 4.7 |
| $C_{10}$ Aromatics | — | 0.5 | 0.4 | 0.6 |
| Toluene Conversion, wt. % | | 39.3 | 43.0 | 44.1 |
| Ethylbenzene Conversion, wt. % | | 87.4 | 93.4 | 94.6 |
| $C_7$–$C_9$ Paraffin Conversion, wt. % | | 99.4 | 100.0 | 100.0 |
| Ethylbenzene Concentration in $C_8$ Aromatics, wt. % | | 5.5 | 3.1 | 2.7 |

[a]The $C_7$–$C_9$ paraffins in the feed consisted of (wt. %); 2.8% n-heptane, 2.7% n-octane, and 0.1% n-nonane.

The examples cited on Table II show a net production of benzene and xylenes at the expense of ethylbenzene and toluene, and illustrate that ethylbenzene conversion can be increased to as high as 95% by raising the reaction temperature from 800° to 900° F.

EXAMPLE IV AND V

The conditions of Examples I–III were repeated at a temperature of 850° F. and different contact times. The results appear in Table III.

TABLE III

Conversion of Pyrolysis Gasoline Fraction to Benzene and Xylenes: Effect of Contact Time Catalyst: 5% $MoO_3$, 3% $WO_3$, 60% H-Zeolon/40% $Al_2O_3$

| Example | | IV | V |
|---|---|---|---|
| Conditions: | | | |
| Temperature, 20° F. | | 850 | 850 |
| Pressure, psig | | 465 | 465 |
| WHSV | | 17.4 | 3.5 |
| Contact Time, sec. | | 3.1 | 14.8 |
| $H_2$/HC Mole Ratio | | 6.1 | 6.3 |
| Product Analysis | | Yield, wt. % | |
| | Feed | | |
| $C_1$ to $C_6$ Paraffins | — | 5.7 | 14.7 |
| Methane | | 0.1 | 0.6 |
| Ethane | | 1.5 | 5.5 |
| Propanes | | 2.1 | 5.9 |
| Butanes | | 1.5 | 2.2 |
| Pentanes | | 0.4 | 0.5 |
| Hexanes | | 0.1 | — |
| $C_7$ to $C_9$ Paraffins[a] | 5.6 | 1.7 | — |
| Benzene | 2.7 | 16.7 | 20.3 |
| Toluene | 65.1 | 44.7 | 37.7 |
| Ethylbenzene | 10.3 | 2.5 | 0.7 |
| Xylenes | 14.7 | 21.1 | 21.1 |
| $C_9$ Aromatics | 1.6 | 7.0 | 5.7 |
| $C_{10}$ Aromatics | — | 0.6 | 0.4 |
| Toluene Conversion, wt. % | | 31.3 | 43.0 |
| Ethylbenzene Conversion, wt. % | | 75.3 | 93.4 |
| $C_7$–$C_9$ Paraffin Conversion, wt. % | | 70.3 | 100 |
| Ethylbenzene Concentration in $C_8$ Aromatics, wt. % | | 10.7 | 3.1 |

[a]The $C_7$–$C_9$ paraffins in the feed consisted of (wt. %); 2.8% n-heptane, (2.7 n-octane, and 0.1% n-nonane.

The examples cited in Table III illustrate that the conversion of ethylbenzene can be significantly increased by increasing the contact time. The increase in ethylbenzene conversion is accompanied by a corresponding increase in benzene and ethane yield indicating that the ethylbenzene is undergoing hydrodeethylation. A marked increase in $C_7$–$C_9$ paraffin conversion is also achieved by increasing the contact time.

EXAMPLES VI AND VII

The conditions of Examples IV and V were repeated but with an increased hydrogen to hydrocarbon mole ratio. The results appear in Table IV.

TABLE IV

Conversion of Pyrolysis Gasoline Fraction to Xylenes and Benzene: Effect of $H_2$:HC Ratio Catalyst: 5% $MoO_3$, 3% $WO_3$, 60% H-Zeolon/40% $Al_2O_3$

| Example | | VI | VII |
|---|---|---|---|
| Conditions: | | | |
| Temperature, ° F. | | 850 | 850 |
| Pressure, psig | | 465 | 465 |
| WHSV | | 254 | 12.2 |
| Contact Time, sec. | | 3.1 | 3.1 |
| $H_2$/HC Mole Ratio | | 3.9 | 9.1 |
| Product Analysis | | Yield, wt. % | |
| | Feed | | |
| $C_1$ to $C_6$ Paraffins | — | 4.1 | 9.2 |
| Methane | 0.1 | 0.2 | |
| Ethane | | 0.9 | 2.7 |
| Propanes | | 1.5 | 2.9 |
| Butanes | | 1.3 | 2.7 |
| Pentanes | | 0.2 | 0.7 |
| Hexanes | | 0.1 | — |
| $C_7$ to $C_9$ Paraffins[a] | 6.0 | 1.2 | 0.3 |
| Benzene | 2.9 | 13.6 | 18.9 |
| Toluene | 64.6 | 49.0 | 42.4 |
| Ethylbenzene | 10.8 | 3.7 | 1.5 |
| Xylenes | 13.9 | 20.1 | 21.6 |
| $C_9$ Aromatics | 1.8 | 7.4 | 5.8 |
| $C_{10}$ Aromatics | — | 0.7 | 0.6 |
| Toluene Conversion, wt. % | | 24.1 | 34.4 |
| Ethylbenzene Conversion, wt. % | | 65.2 | 91.9 |
| $C_7$–$C_9$ Paraffin Conversion, wt. % | | 86.8 | 95.8 |
| Ethylbenzene Concentration in $C_8$ Aromatics, wt. % | | 15.7 | 6.3 |

[a]The $C_7$–$C_9$ paraffins in the feed consisted of (wt. %); 2.4% n-heptane, 3.5% n-octane, and 0.1% n-nonane.

The examples cited in Table IV show that ethylbenzene conversion to benzene and ethane, as well as the conversion of $C_7$–$C_9$ paraffins can be increased by increasing the $H_2$/HC mole ratio in the feed.

What is claimed is:

1. A process for producing ethylbenzene-lean xylenes and benzene wherein a fractionated pyrolysis gasoline aromatics stream which boils within a range from about 230° to 340° F., comprising toluene, $C_7$–$C_9$ paraffins, olefins, naphthenes, ethylbenzene and xylenes is mixed with hydrogen, and subjected to a hydrodealkylation/-transalkylation reaction under conditions including a temperature within the range of from 600° to about 1000° F., a pressure in the range of from about 100 to 1000 psig, a hydrogen to hydrocarbon mole ratio of from about 1:1 to 50:1, a contact time within the range of between 1 to 20 seconds and a catalyst composition comprising a tungsten/molybdenum component of $WO_3$ and $MoO_3$ with an acidic component of mordenite on a high surface area alumina support.

2. The process of claim 1 wherein the said tungsten/-molybdenum component comprises tungsten being present in an amount within the range of from about 1 to 10 (wt) % expressed as $WO_3$ and molybdenum being present in an amount within the range of from about 1 to 20 (wt) %, expressed as $MoO_3$ and based upon the weight of the catalytic composition.

3. The process of claim 1 wherein the said acidic component of mordenite and high surface area alumina comprises the said mordenite being present in an amount within the range of from 5 to about 95 (wt) % and the catalytically active alumina being present in an amount within the range of from 95 to 5 (wt) %.

4. The process of claim 1 wherein the said catalyst composition comprises a tungsten/molybdenum component of 3 (wt) % $WO_3$ and 5 (wt) % $MoO_3$ of total weight of said catalytic composition and an acidic component comprising 60 (wt) % mordenite and 40 (wt) % catalytically active alumina of total weight of said acidic cracking component.

5. The process of claim 4 wherein the said mordenite is in the hydrogen form and the said alumina is gamma alumina.

6. The process of claim 1 wherein said catalyst composition comprises the sulfided form.

7. The process of claim 1 wherein the said reaction products are separated from unreacted feedstocks.

8. The process of claim 1 wherein the said hydrogen to hydrocarbon mole ratio is from about 4:1 to 10:1 at approximately 465 psig.

9. The process of claim 1 wherein the said contact time is from 3 to 10 seconds.

10. The process of claim 1 wherein the said temperature is within the range from about 750° to 950° F.

* * * * *

UNITED STATES PATENT OFFICE

CERTIFICATE OF CORRECTION

Patent No. 4,150,061 Dated April 17, 1979

Inventor(s) Allen I. Feinstein and Un K. Im

It is certified that error appears in the above-identified patent and that said Letters Patent are hereby corrected as shown below:

| Patent Column | Line | |
|---|---|---|
| 1 | 19 | "aromatic-ring" should be --aromatic-rich-- |
| 3 | 11-12 | "non-aromatics selectively" should be --non-aromatics is selectively-- |
| 10 | 31 | "Temperature, 20°F" should be --Temperature, °F-- |
| 10 | 53 | "(2.7 n-octane," should be --2.7% n-octane-- |
| 11 | 9 | "254" should be --25.4-- |
| Table IV | | Entries for "Methane" are shifted one space to the left |

Signed and Sealed this

*Twelfth* Day of *August 1980*

[SEAL]

*Attest:*

SIDNEY A. DIAMOND

*Attesting Officer*

*Commissioner of Patents and Trademarks*